United States Patent [19]

Kuwano

[11] Patent Number: 4,570,472

[45] Date of Patent: Feb. 18, 1986

[54] METHOD AND APPARATUS FOR CONTROLLING LATERAL UNSTABLE MOVEMENT AND CAMBER OF STRIP BEING ROLLED

[75] Inventor: Hiroaki Kuwano, Yokohama, Japan

[73] Assignee: Ishikawajima-Harima Jukogyo Kabushiki Kaisha, Tokyo, Japan

[21] Appl. No.: 599,069

[22] Filed: Apr. 11, 1984

[30] Foreign Application Priority Data

Apr. 12, 1983 [JP] Japan ..... 58-64369

[51] Int. Cl.[4] ..... B21B 39/16; B21B 37/00

[52] U.S. Cl. ..... 73/8; 72/11; 72/21; 72/235

[58] Field of Search ..... 72/12, 11, 10, 8, 9, 72/235, 250, 6, 21

[56] References Cited

U.S. PATENT DOCUMENTS

| | | | |
|---|---|---|---|
| 3,425,249 | 2/1969 | O'Brien | 72/250 X |
| 3,491,562 | 1/1970 | Kajiwara | 72/12 |
| 4,248,072 | 2/1981 | Hasegawa et al. | 72/11 |

FOREIGN PATENT DOCUMENTS

| | | | |
|---|---|---|---|
| 53-149275 | 11/1978 | Japan . | |
| 0047206 | 4/1981 | Japan | 72/21 |
| 2100475 | 12/1982 | United Kingdom | 72/10 |

*Primary Examiner*—Lowell A. Larson
*Assistant Examiner*—Steven B. Katz

[57] ABSTRACT

Disclosed is a method and apparatus for controlling lateral unstable movement and camber of a strip being rolled in which the lateral displacement and the camber magnitude of the strip being rolled are directly detected. The lateral unstable movement is controlled by changing the right and left roll gaps of the horizontal rolling mill while the camber of the strip is corrected by changing the path line through the vertical rolling mill. As a result, the lateral unstable movement of the strip can be prevented so that the rolling operation can be carried out in a stable manner. In addition, the quality of the rolled strip can be improved and the yield can be increased.

2 Claims, 6 Drawing Figures

METHOD AND APPARATUS FOR CONTROLLING LATERAL UNSTABLE MOVEMENT AND CAMBER OF STRIP BEING ROLLED

BACKGROUND OF THE INVENTION

The present invention relates to a method and apparatus for controlling lateral unstable movement and camber of a strip being rolled.

Under various rolling conditions, there occurs a phenomenon that a strip being rolled cannot remain at the center portions of work rolls and is forced to move toward one end of the work rolls as shown in FIG. 1. Such phenomenon is referred to as "the lateral unstable movement of the strip" in this specification.

Referring to FIG. 1, the lateral unstable movement of a strip a will be described in detail. FIG. 1 shows that the strip a is caused to move toward the right from the center portion of work rolls b by some rolling disturbance. Then the roll gap is not uniform. That is, the roll gap at the right becomes greater than that at the left. However, the velocity of the work roll b is the same at the right and left so that the volume of material (strip) entering the right gap between the work rolls b per unit time becomes greater than the volume of material (strip) entering the left gap between the work rolls b per unit time. When the strip a enters the work rolls b, the cross section of the strip a is uniform so that the right portion of the strip a is more quickly drawn into the work rolls b than the left portion of the strip a. As a result, as shown in FIG. 2, when the strip material is entering the work rolls b, it is forced to move toward the right ($\Delta x$) so that when the strip material leaves the work rolls b, a camber ($\Delta y$) is produced. As a consequence, the difference between the right and left roll gaps is further increased so that the strip a is quickly forced to move toward the right. As a result, the rapid lateral displacement of the strip occurs and the camber is increased.

In order to prevent the lateral unstable movement of the strip a and the resulting camber, it is effective to roll a strip such that the strip rolled has a positive crown. However, because of the recent demands for high quality and yield, the positive crown must be suppressed and the cross sections in both the lengthwise and widthwise directions must be as uniform as possible. When a strip is rolled so as to attain such results, the lateral unstable movement tends to occur very frequently and the stable rolling operation becomes very difficult.

In order to prevent this instability, there has been demonstrated a method in which the output signals from load cells c and d (See FIG. 1) disposed at the right and left sides of the mill e are used so as to detect whether or not the lateral movement of the strip a occurs so that, if the output from one of the load cells c and d is increased, the rolling force may be increased on the side where the rolling load is increased. However this method has a defect that the output from a load cell contains both a component due to the lateral unstable movement of the strip a and a component due to the increase or decrease in rolling force. Futhermore a control system used is unstable so that vibration tends to occur. In addition, the control of the lateral displacement of the rolled strip a is not accurate in practice.

Even when the lateral unstable movement of the strip can be prevented, a camber is produced because of non-symmetrical-thickness variation of incoming strip in the widthwise direction and an initial camber. A camber is produced further because of temperature difference across the width. However, there has not been proposed any satisfactory solution to these problems. The only countermeasure is that the strip is so rolled that it has a sufficient width and thereafter undesired portions of the rolled strip are cut off so that a rolled strip with a desired plane shape (i.e. shape seen from the above) is provided. As a result, the yield is considerably decreased.

The present invention is made to overcome the above and other problems encountered in the prior art rolling methods and has for its object to prevent the lateral unstable movement of a strip by a stable control method and to correct a camber, whereby the quality of the rolled strip can be improved, the yield can be increased and the rolling operation can be carried out in a stable manner.

The above and other objects, effects, features and advantages of the present invention will become more apparent from the following description of a preferred embodiment thereof taken in conjunction with the accompanying drawings.

DETAILED DESCRIPTION OF THE PREFERRED EMBODIMENT

Figure 1:
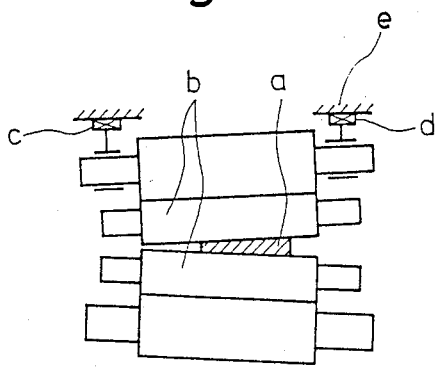
FIG. 1 is a view showing that a strip is caused to be displaced toward one end of a pair of work rolls.
Figure 2:
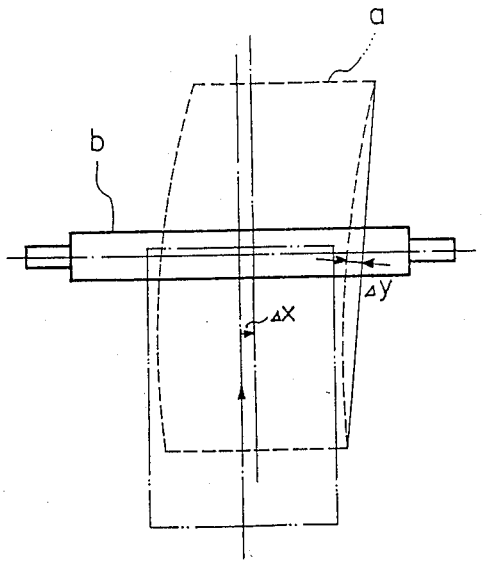
FIG. 2 is a top view thereof.
Figure 3:
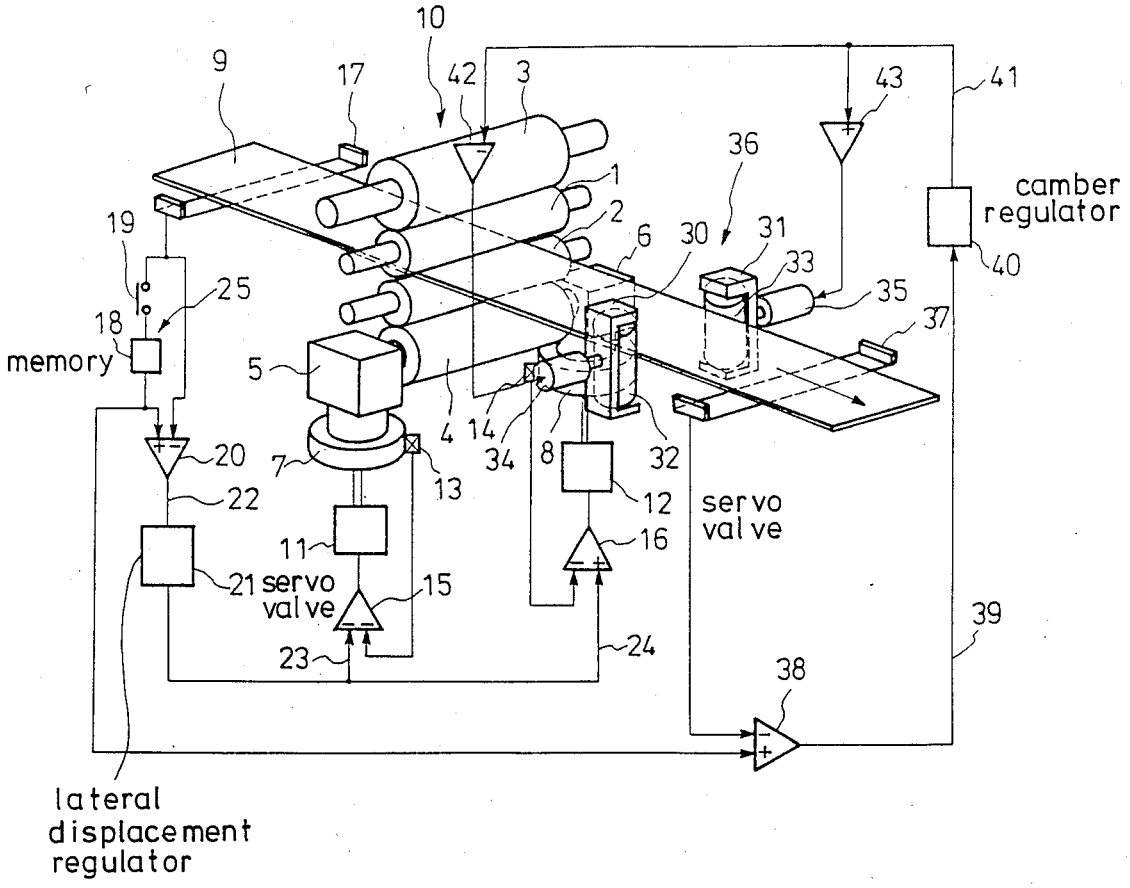
FIG. 3 shows a preferred embodiment of the present invention.

In FIG. 3 is shown a preferred embodiment of the present invention. A hydraulic reduction type horizontal rolling mill 10 has a pair of upper and lower work rolls 1 and 2, a pair of upper and lower backup rolls 3 and 4, chocks 5 and 6 which support the shaft of the lower backup roll 4 (other roll chocks being not shown) and hydraulic cylinders 7 and 8 for exerting the rolling forces to the roll chocks 5 and 6, respectively. Disposed at the downstream side of the horizontal rolling mill 10 is a vertical rolling mill which is generally indicated by the reference numeral 36 and comprises vertical rolls 32 and 33 supported by vertical roll chocks 30 and 31, respectively, and hydraulic cylinders 34 and 35 so that a strip 9 is rolled in the widthwise direction.

The hydraulic cylinders 7 and 8 are communicated with servo valves 11 and 12, respectively, so that the quantity of work oil charged into or discharged from the hydraulic cylinders 7 and 8 may be controlled. Attached to the hydraulic cylinders 7 and 8 are piston-displacement sensors 13 and 14, respectively, so that the strokes of the piston of the hydraulic cylinders 7 and 8 can be detected. Operational amplifiers 15 and 16 are connected to the servo valves 11 and 12, respectively, so that the output signals from the piston-displacement sensors 13 and 14 can be compared with a reference signal.

The left and right roll gaps are controlled by controlling the quantity of working oil charged into or discharged from the hydraulic cylinders 7 and 8 in response to the output signals from the servo valves 11 and 12. Variations in roll gap can be indirectly detected by the piston-displacement sensors 13 and 14 which detect the displacement of the piston rods of the hydraulic cylinders 7 and 8, respectively. The outputs from the sensors 13 and 14 are compared with a reference signal in the operational amplifiers 15 and 16. If there exists any difference between the output from the sensor 13 and 14 and the reference signal, the servo valve 11 or 12 is controlled in response to the difference thus obtained, whereby correction is made.

A strip lateral displacement sensor 17 for detecting the lateral movement of the strip 9 is disposed on the upstream side of the horizontal rolling mill 10 and the output from the sensor 17 is compared in an operational amplifier 20 with the output signal derived from a set-point determination circuit 25 comprising a memory 18 and a relay 19. The output signal 22 derived from the operational amplifier 20 is processed by a lateral displacement regulator 21 so that the left and right roll gap correction signals 23 and 24 are derived and applied to the operational amplifiers 15 and 16, respectively.

Another sensor 37 detecting the lateral movement of the strip (hereafter referred to as a camber sensor) is disposed at the downstream side of the vertical rolling mill 36 and the output from the sensor 37 is compared in an operational amplifier 38 with the output signal from the set-point determination circuit 25. The output signal 39 from the amplifier 38 is processed by a camber regulator 40 so that the output signal 41 for correcting the positions of the left and right vertical rolls 32 and 33 is derived and applied to operational amplifiers 42 and 43 which control the cylinders 34 and 35. The camber control system described above is substantially similar to the horizontal-rolling-mill control system so that no detail is shown in FIG 3.

When the rolling is started, the relay 19 is turned off so that the instantaneous position of the strip 9 detected by the strip lateral displacement sensor 17 is sotred in the memory 18 and the output from the memory 18 is applied to the amplifier 20 as a set point and to the amplifier 38 as a signal which is used as a base to calculate a camber.

First, the control of the lateral unstable movement will be described. When the lateral unstable movement of the strip 9 occurs, the displacement is detected by the strip lateral displacement sensor 17 and is compared in the amplifier 20 with a set point. As a result, the signal 22 is derived and applied to the lateral displacement regulator 21. The regulator 21 may comprise, for instance, an amplifier or a proportional gain circuit. Alternatively, it may be a proportion-differentiation circuit or a proportion-differentiation-integrating circuit. One of them is selected depending upon the position where the lateral displacement sensor 17 is disposed and upon kinds of external disturbances.

The output from the regulator 21 is applied to the amplifiers 15 and 16 as the left and right roll gap-correction signal. In the amplifiers 15 and 16, the piston-displacement signals and the roll gap-correction signals are compared and in response to the difference signals obtained the servo valves 11 and 12 control the quantity of working oil charged into or discharged from the hydraulic cylinders 7 and 8. As a consequence, the left and right roll gaps are varied so that the strip 9 is forced to return to the set point which is stored in the memory 18.

Figure 4:
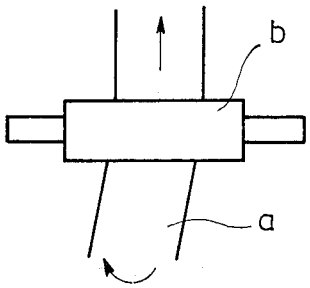
FIG. 4 shows the inclination of a strip being rolled caused when there is a difference between the right and left roll gaps.
Figure 5:
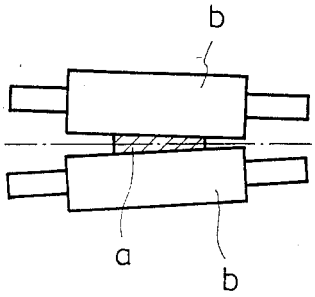
FIG. 5 shows in cross section the strip being rolled when the strip is inclined as shown in FIG. 4.

More particularly, the difference in rolling loads applied to the right and left sides of the rolling mill is caused by the difference in hardness across the width of the strip being rolled, a taper in the widthwise direction of the strip, the off-center (that is, the phenomenon that the center line of the strip entering the work rolls does not coincide with the center line of a rolling mill), resulting in the difference in rolling gap between the right and left sides. As a result, the strip drawing velocity is faster at the side of a wider roll gap than at the side of a narrower roll gap. Therefore as shown in FIG. 4, the strip which enters the work rolls is caused to incline at an angle with respect to the center line of a rolling mill; that is, with respect to the direction in which the strip is passed. The inclined strip a is advanced at right angles with respect to the axis of a work roll b so that the strip a is laterally displaced toward the side at which the roll gap is larger—this phenomenon is referred to as lateral unstable movement in this specification. As a result, the roll gap is increased further and the lateral displacement of the rolled strip is further promoted. The roll gap is formed as shown in FIG. 5. Once the lateral unstable movement is started as described above, it becomes difficult to roll the strip in a stabilized manner.

When there is a difference in roll gap between the right and left sides of the rolls, the lateral displacement of a strip toward the side of a wider roll gap occurs. Therefore the roll gap to which the strip being rolled is displaced must be reduced.

Next the camber correction will be described. The amplifier 38 calculates the difference between the output signal from the sensor 17 and the output from the camber sensor 37 (which detects the position of the strip 9 leaving from the vertical rolling mill 36) and the output from the amplifier 38 is applied to the camber regulator 40.

Figure 6:
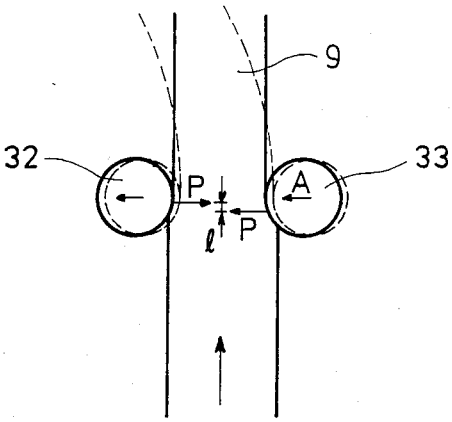
FIG. 6 is a plane view used to explain the principle of camber correction.

The output from the camber regulator 40 is applied as a set point 41 for a vertical-roll-position control system (not shown) to the amplifiers 42 and 43 and which in turn compare the piston-displacement signals (not shown) from the cylinders 34 and 35 with the position correction signal 41. In response to the difference signal, servo valves (not shown) are driven so that the positions of the vertical rolls 32 and 33 may be varied. That is, the vertical rolls 32 and 33 are shifted by the same amount in the direction of the strip camber. In other words, the path line is varied so that a bending moment M is exerted to the strip 9 (See FIG. 6). In FIG. 6, dot lines show the initial situation; and reference letter A denotes the direction of shift; l, the distance of load point between right and left vertical rolls; and P, the load force. Then, the above-mentioned bending moment M is given by $$M = P \cdot l$$

As described above, according to the present invention, the lateral unstable movement and camber of a strip can be directly detected. The lateral unstable movement is controlled by controlling the left and right roll gaps of the horizontal rolling mill. The camber of the rolled strip is corrected by changing the path line through the vertical rolling mill. As a result, the lateral unstable movement of the strip can be prevented so that the rolling operation can be carried out in a stable manner. In addition, the camber of the rolled strip can be eliminated. Thus the yield of the rolled strip can be remarkably improved.

So far it has been described that the camber sensor is disposed downstream of the vertical rolling mill, but it is to be understood that it may be interposed between the horizontal and vertical rolling mills 10 and 36. In addition, a plurality of camber sensors may be used. Moreover, as far as the lateral displacement sensor and the camber sensor can detect the edges of the strip being rolled, they may be of a contact or non-contact type.

What is claimed is:

1. A method for controlling lateral unstable movement and camber of a strip being rolled which comprises detecting a lateral deviation of the strip entering and leaving a horizontal rolling mill and changing right and left roll gaps of said horizontal rolling mill in response to said deviation of the strip entering the horizontal rolling mill, thereby controlling the lateral unstable movement of the strip being rolled, and deriving the camber of the strip from the lateral deviation of the strip leaving said horizontal rolling mill and said lateral deviation of said strip entering the horizontal rolling mill correcting the camber of the strip being rolled by controlling the position of the rolls of a vertical rolling mill disposed downstream of said horizontal rolling mill.

2. An apparatus for controlling lateral unstable movement and camber of a strip being rolled comprising a horizontal rolling mill having roll gap adjusting means, a vertical rolling mill having roll positioning means and being disposed downstream of said horizontal rolling mill, sensor means disposed upstream and downstream of said horizontal rolling mill for detecting lateral deviations of the strip being rolled, comparison means connected to said sensor means and a reference signal means for comparing a signal derived from said sensor means disposed upstream of said horizontal rolling mill said signal being representative of such deviation, with a reference signal from said reference signal means establishing a set point for locating the strip at a predetermined position, means connected to said comparison means for processing an output signal from said comparison means, thereby generating and transmitting right and left roll gap-correction signals to said roll gap adjusting means for said horizontal rolling mill, camber deriving means connected to said downstream sensor means and said reference signal means for deriving a camber by comparing a deviation signal derived from said sensor means disposed downstream of said horizontal rolling mill with said set point, and position correcting means connected to said camber deriving means and said vertical roll positioning means for processing an output signal derived from said camber deriving means, thereby generating and transmitting a roll position-correction signal to said vertical roll positioning means for said rolling mill, whereby the roll gap of said horizontal rolling mill is changed in response to said roll gap-correction signal and the lateral position of the strip being rolled in said vertical rolling mill is changed in response to said roll-position-correction signal.

* * * * *